US006219004B1

(12) United States Patent
Johnson

(10) Patent No.: US 6,219,004 B1
(45) Date of Patent: Apr. 17, 2001

(54) ANTENNA HAVING HEMISPHERICAL RADIATION OPTIMIZED FOR PEAK GAIN AT HORIZON

(75) Inventor: Jeffrey A. Johnson, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/329,852

(22) Filed: Jun. 11, 1999

(51) Int. Cl.[7] ..... H01Q 19/12
(52) U.S. Cl. ..... 343/781 P; 343/705
(58) Field of Search ..... 343/705, 781 R, 343/834, 781 P; H01Q 19/12

(56) References Cited

U.S. PATENT DOCUMENTS

| | | | | |
|---|---|---|---|---|
| 2,549,143 | * | 4/1951 | Tinus | 343/781 R |
| 2,881,431 | * | 4/1959 | Hennessey | 343/781 R |
| 2,921,309 | * | 1/1960 | Elliott | 343/781 R |
| 4,458,249 | | 7/1984 | Valentino et al. | 343/754 |
| 4,520,363 | | 5/1985 | Wachspress et al. | 343/828 |
| 5,121,129 | | 6/1992 | Lee et al. | 343/753 |
| 5,486,838 | * | 1/1996 | Dienes | 343/781 R |
| 5,654,724 | | 8/1997 | Chu | 343/742 |

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

An antenna, such as may be employed for air-to-ground link hemispherical communication coverage, comprises a shaped ring focus type subreflector, that is rotationally symmetric about the boresight axis of a feed horn to which communication equipment on board an unmanned aerial vehicle is coupled. There is no main reflector associated with the shaped subreflector, so that rays from the subreflector, which emanate in a generally hemispherical pattern, are not intercepted. The generally hemispherical radiation pattern extends toward the horizon and encompasses a ground station. The subreflector is preferably shaped such that the hemispherical radiation pattern has a peak gain profile that extends from a first prescribed elevation differential slightly above the horizon to a second prescribed elevation differential slightly below the horizon. Although the feed horn causes a partial blockage of rays reflected by the shaped subreflector directly beneath the antenna, reduction in nadir gain is quite tolerable in a UAV application, as it lasts for only a fraction of second when the UAV platform passes directly over the ground station, where range-based propagation loss is minimum. Also, as the principal theater of deployment of a UAV is geographically remote from the ground station, nadir-associated gain reduction is not a practical problem.

17 Claims, 3 Drawing Sheets

ANTENNA HAVING HEMISPHERICAL RADIATION OPTIMIZED FOR PEAK GAIN AT HORIZON

FIELD OF THE INVENTION

The present invention relates in general to communication systems, and is directed to a new and improved antenna that may be employed for providing hemispherical coverage for air-to-ground communications, with a radiation/directivity pattern that is readily tailored or optimized to mitigate against sensitivity degradation in the vicinity of the horizon, such as may be associated with multipath, increased range, and rain.

BACKGROUND OF THE INVENTION

A variety of communication platforms, such as an unmanned aerial vehicle (UAV)-mounted system diagrammatically illustrated at 10 in FIG. 1, are required to maintain effectively continuous broadbeam communication capability (with a ground station 12) without having to (physically or electronically) steer the aerial system's antenna 14. Because both the range and direction of the aerial vehicle-mounted system, relative to the ground station, are dynamic, it is essential that the airborne equipment's antenna 14 provide communication coverage that is at least hemispheric. The antenna should provide somewhat 'above the horizon' coverage, and be designed for circular polarization, in order to accommodate changes in aircraft attitude (roll, pitch and yaw). In addition, because of the significant reduction in signal strength, increased probability of multipath and rain fades at the horizon, especially at X band and higher frequencies, it is preferred that the antenna's radiation/directivity pattern exhibit peak gain at or in the vicinity of the horizon.

Unfortunately, existing antenna architectures address only subsets of these requirements. For example, as diagrammatically shown in FIG. 2, a biconical antenna 20 exhibits a very narrow, flat pattern 21, which has a peak gain 22 at the horizon, and is therefore potentially well suited for long range, reduced elevation look angle coverage. Unfortunately, the gain over the remainder of the characteristic drops off very rapidly from the horizon peak and exhibits a null or close to a null over a very substantial portion of coverage on either side of nadir 23 (looking straight down). Even though relatively low gain can be tolerated at nadir, the very significant reduction in gain exhibited by a biconical antenna over a wide portion of intended coverage between nadir and the vicinity of the horizon is not acceptable. A further drawback to a biconical antenna is the need for an external polarizer.

A bifilar helical configuration, such as diagrammaticallly shown at 30 in FIG. 3, on the other hand, has a relatively wide beam radiation pattern 32, which exhibits significant gain not only at and in the vicinity of the horizon 33, but also over a major coverage look angle that is well displaced from the horizon. However, a major drawback to a bifilar helix configuration is the fact that it has a poor axial ratio for circular polarization. In addition, the upper end of the performance bandwidth of bifilar helical antennas is limited to the neighborhood of 20–25 GHz.

Other conventional antenna architectures that have been proposed for non-steered broad coverage (UAV) applications include circular dipoles (which suffer the same limitations as the biconical approach), patch antennas (which have a null at the horizon), and slot arrays (which suffer reduced gain toward the horizon, require an external polarizer and have unproven performance). A further problem of each of the above conventional approaches is the fact that the antenna pattern cannot be shaped as necessary to provide optimal coverage for a particular application.

SUMMARY OF THE INVENTION

In accordance with the present invention, the above enumerated shortcomings of conventional antenna configurations that have proposed for hemispherical, or quasi-hemispherical, (air-to-ground) coverage are effectively obviated by a new and improved shaped (ring focus subreflector-based) antenna architecture, which exhibits a hemispherical radiation pattern that not only mitigates against sensitivity degradation in the vicinity of the horizon, but which can be tailored or optimized for a specific application.

For this purpose, the antenna of the present invention comprises a shaped ring focus type subreflector (e.g., shaped ellipsoid), that is rotationally symmetric about the boresight axis of a feed horn to which communication equipment of a first communications location (e.g., on board a UAV) is coupled. There is no main reflector associated with the shaped subreflector, as in a conventional ring focus antenna architecture, so that rays emanating from the subreflector (in a generally hemispherical pattern) are not intercepted and redirected by a main reflector.

The generally hemispherical radiation pattern exhibits a peak gain toward the horizon and encompasses a second communications location (e.g., ground station) with which a communications link from the first location is established. Preferably the subreflector is shaped such that the generally hemispherical radiation pattern produced thereby has a peak gain in a peak gain region that extends from a first prescribed elevation differential slightly above the horizon to a second prescribed elevation differential slightly below the horizon.

The feed horn causes a partial blockage of rays emanating directly beneath the antenna (i.e., reflected by the shaped subreflector straight down toward the ground). Although this causes a reduction in antenna gain in the nadir direction, it is quite tolerable in a UAV application, as it will last for only a very abbreviated interval (fraction of second) when the UAV platform passes directly overhead (at which point range-based propagation loss is minimum). Moreover, as the principal theater of deployment of a UAV is over a hostile environment that is geographically remote from the ground station (and therefore at low elevation angle where the directivity pattern has substantial gain and no blockage), rather than directly over the ground station, nadir-associated gain reduction is not a practical problem.

DETAILED DESCRIPTION

Figure 1:
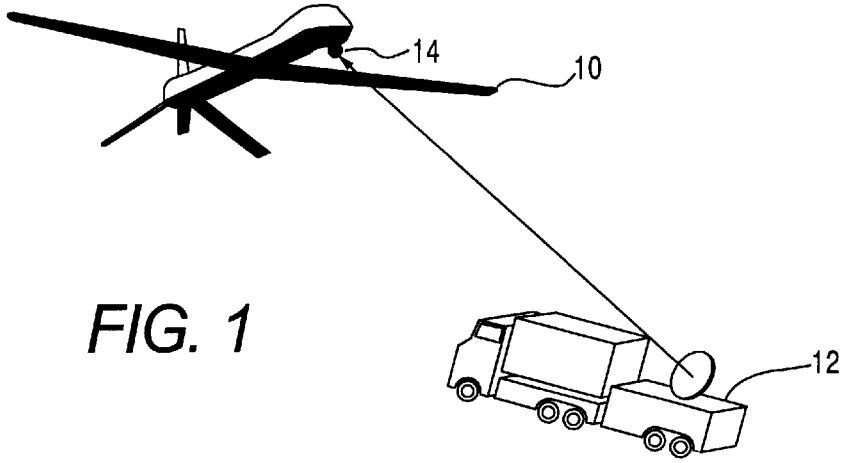
FIG. 1 diagrammatically illustrates an unmanned aerial vehicle (UAV)-mounted communication system.
Figure 2:
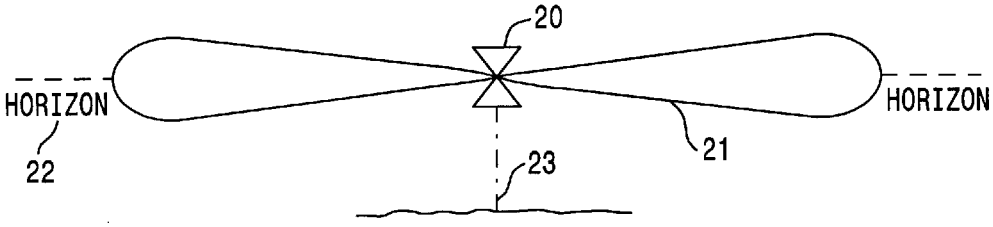
FIG. 2 PRIOR ART
FIG. 2 diagrammatically illustrates the radiation pattern associated with a biconical antenna.
Figure 3:
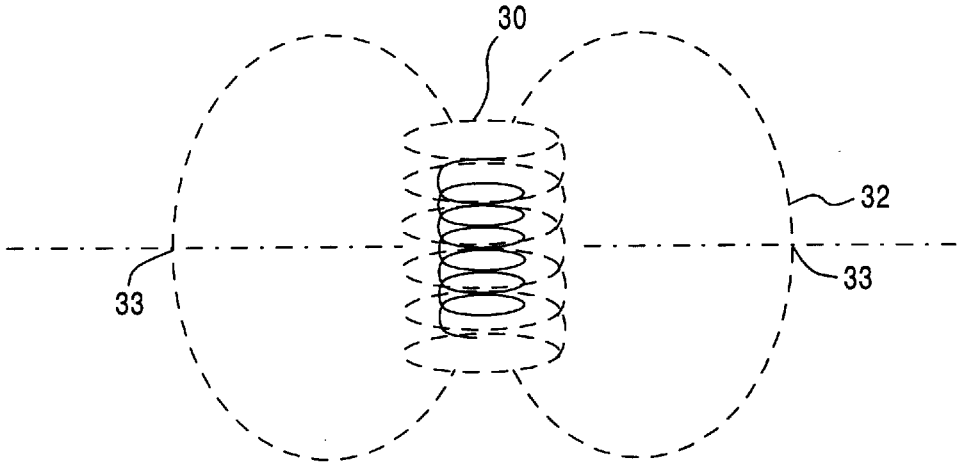
FIG. 3 PRIOR ART
FIG. 3 diagrammatically illustrates the radiation pattern associated with a bifilar helix antenna.
Figure 4:
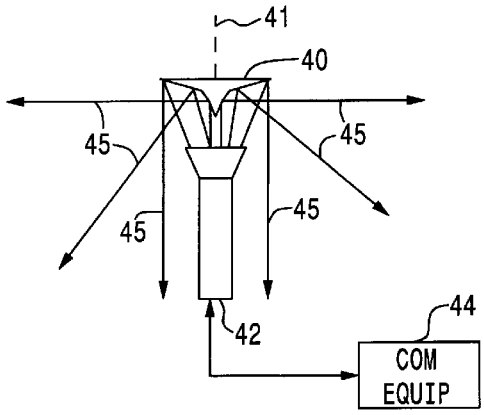
FIG. 4 diagrammatically illustrates a hemispherical coverage antenna architecture of the present invention.
Figure 5:
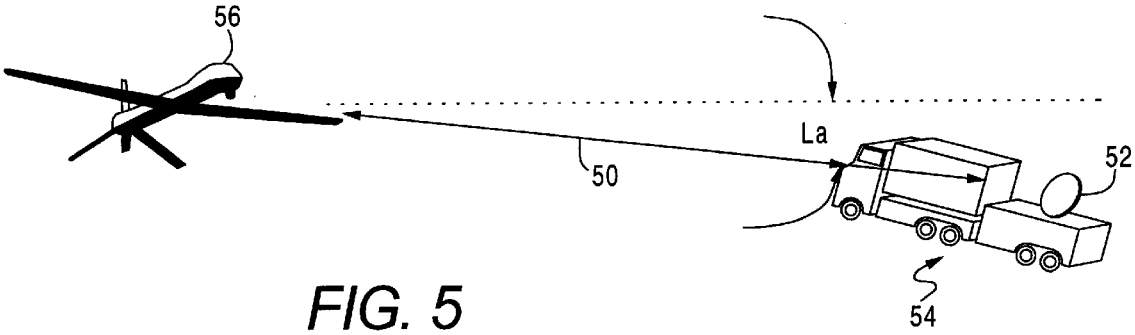
FIG. 5 diagrammatically illustrates a non-limiting example of an application of the antenna of the invention for closing a communications link between a ground station and an unmanned aerial vehicle (UAV)

As described briefly above, and is diagrammatically illustrated in FIG. 4, the hemispherical coverage antenna architecture of the present invention comprises a shaped (ring focus type) subreflector 40, that is coupled to interface RF energy with a feed horn 42 to which communication equipment 44 is coupled. In order to provide a non-limiting, but practical example of the invention to an application requiring hemispherical communication coverage, and as shown in FIG. 5, the present description will detail the use of the antenna of the invention for closing a communications link 50 between communications equipment 52 located at a ground station 54 and communications equipment on board a dynamic, airborne platform, such as an unmanned aerial vehicle (UAV) 56 intended to operate in a theatre geographically remote from ground station 54, and observable via a very narrow look angle La. It should be observed however, that the antenna of the present invention is not limited to use with this particular application; it may be readily employed in other communication environments, such as satellite communications, radar, and ground station systems.

Figure 6:
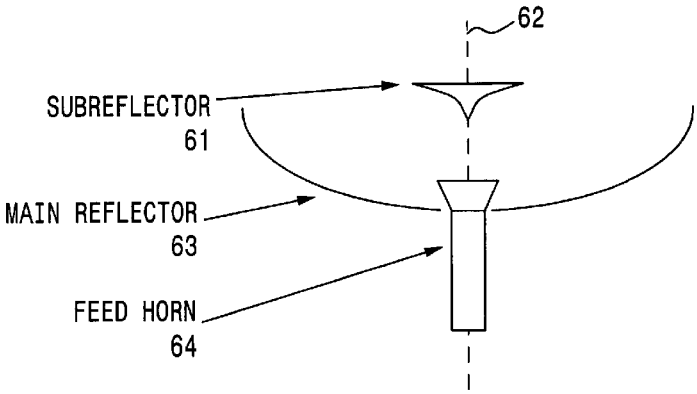
FIG. 6 PRIOR ART
FIG. 6 diagrammatically shows a conventional ring focus antenna.

Also, by shaped subreflector is meant an ellipsoid-shaped subreflector of the type employed in a ring focus antenna, such as that diagrammatically shown in FIG. 6. In a standard ring focus configuration, the conical properties of the ellipsoid-shaped subreflector 61 provide a dual focus characteristic, with one of its foci being symmetric about the antenna's axis 62 in the form of a ring, which makes it possible to realize a generally uniform amplitude distribution in the aperture plane, so that the antenna is more compact than a conventional center-fed structure. In a conventional ring focus arrangement, the other focus is displaced toward the vicinity of the aperture of the main reflector 63 where a feed horn 64 is installed.

Figure 7:
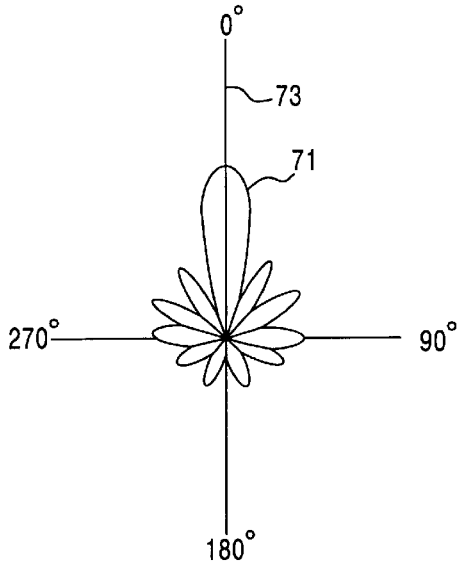
FIG. 7 PRIOR ART
FIG. 7 shows a directivity pattern associated with the ring focus antenna of FIG. 6.

The directivity pattern of the conventional ring focus antenna of FIG. 6 is shown in polar format in FIG. 7, with most of the energy being concentrated in a main lobe 71 coincident with the antenna's boresight axis 73. For non-limiting examples of publications detailing the architecture and operation of a standard ring focus antenna, attention may be directed to the following documentation: "Amplitude Aperture-Distribution Control in Displaced-Axis Two-Reflector Antennas," by A. Popov et al, Antenna Designer's Notebook, IEEE Antennas and Propagation Magazine, Vol. 39, No. 6, December 1997, pp. 58–63; "The Theoretical Analysis of Shaped Dual-Reflector Antenna with Ring Focus," by T. Wang et al, Conference Proceedings, 20th European Microwave Conference 90, pp 1553–1558; "Shaped Dual-Reflector Antenna with Ring Focus," by R. Zhang et al, Science in China (Series A) Vol. 34, No. 10, October 1991, pp 1243–1255; "Two-Reflector Antenna," by Y. Erukhimovich et al, Radio Research Institute, Ministry of Posts and Telecommunications, USSR, pp. 205–207; and the Canadian Patent to Schwarz, No. 1,191,944, entitled "Improved Shifted Focus Cassegrain Antenna With Low Gain Feed," and assigned to the assignee of the present application.

In the diagrammatic illustration of the present invention in FIG. 4, the shaped subreflector 40 preferably comprises such an ellipsoid-configured subreflector, which is rotationally symmetric about a boresight axis 41 of feed horn 42, as in the conventional ring focus configuration of FIG. 6. However, since the objective of the antenna architecture of the present invention is to provide hemispherical coverage with a substantial gain at the horizon, rather than along the axis of the feed horn, the parabolic main reflector shown at 63 in the conventional ring focus design of FIG. 6 is eliminated. As a consequence, ray traces 45 emanating in a generally hemispherical pattern from the shaped subreflector 40 will not be intercepted and redirected by the removed main reflector in a direction that is generally parallel to the antenna's boresight axis 41. Instead, the RF energy is allowed to propagate in a generally hemispherical radiation pattern.

As pointed out above, the present invention may employ a ring focus subreflector, which has its shape or geometry tailored for a specific application. As a non-limiting example, such application-optimizing of the shape of the subreflector may be carried out as described in co-pending U.S. patent application Ser. No. 09/163,651, filed Sep. 30, 1998, by T. Durham et al, entitled: "Multiband Ring Focus Antenna Employing Shaped-Geometry Main Reflector and Diverse-Geometry Shaped Subreflector-Feeds," assigned to the assignee of the present application and the disclosure of which is incorporated herein.

As described in that application, antenna reflector shaping may be carried out using a prescribed set of directivity pattern relationships and boundary conditions, rather than a shape that is definable by an equation for a regular conic, such as a parabola or an ellipse. Then, given prescribed feed inputs to and boundary conditions for the antenna, the shape of the subreflector may be readily generated by executing a computer program that solves a prescribed set of equations for the predefined constraints. In a preferred embodiment, the equations are those which achieve conservation of energy across the antenna aperture, provide equal phase across the antenna aperture, and obey Snell's law.

While the boundary conditions may be selected to define a regular conical shape, such is not the intent of the shaping of the subreflector. The ultimate shape of each subreflector will be whatever the parameters of the operational specification of the antenna dictate, when applied to the intended directivity pattern relationships and boundary conditions. Depending upon the design parameters, the subreflector may have a non-regular conical surface of revolution that is generally (but not necessarily precisely) elliptical, so that the shape of the subreflector may be termed 'pseudo' elliptical.

Once the shape of a subreflector has been generated, the performance of the antenna is subjected to computer analysis, to determine whether the generated antenna shape will produce a desired directivity characteristic. If the design performance criteria are not initially satisfied, one or more of the parameter constraints are adjusted, and performance of the antenna is analyzed for the new subreflector shape. This process is iteratively repeated, until the shaped subreflector meets the antenna's intended operational performance specification.

In addition to shaping the subref lector as a non-regular conical surface of revolution, the feed horn may be placed relatively close to the shaped subreflector, e.g., within a distance on the order of two to three wavelengths of the vertex of the subreflector, as described in the above-referenced co-pending application. This close placement of the feed to the subreflector reduces hardware size and facilitates installation on a UAV. This is in contrast with the multiple tens of wavelengths spacing of a conventional regular conic ring focus antenna, in which the ellipsoid subreflector has a similarly dimensioned diameter. Also, as further described in the cited application, the shaped subreflector may include a single generally notch/wedge-shaped, edge current-limiting filter at its peripheral edge, to reduce radial currents at the peripheral edge of the subreflector, and a filter may be installed at the open end of the antenna feed horn.

Figure 8:
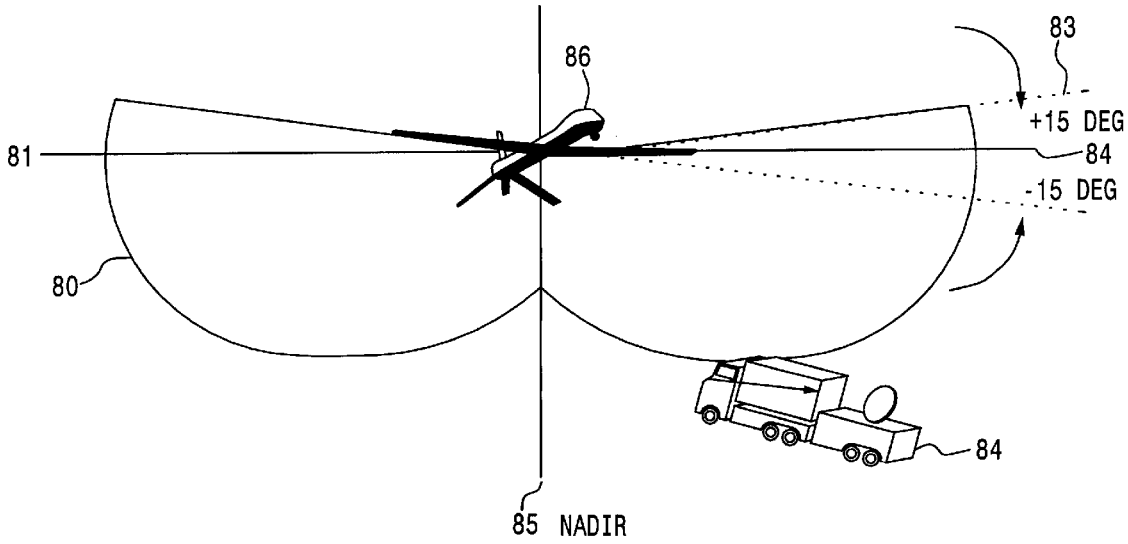
FIG. 8 shows a generally hemispherical radiation pattern produced by the antenna of the present invention.

FIG. 8 shows a generally hemispherical radiation pattern 80 that is produced by the antenna of the present invention, the pattern extending from the horizon 81 and encompassing a hemispheric volume that encompasses a ground station 84 with which the communications link from UAV 86 is established. In order to accommodate changes in aircraft attitude (roll, pitch and yaw), and because of the significant reduction in signal strength with increasing distance, as well as increased probability of multipath and rain fades at the horizon, especially at X band and higher frequencies, as noted previously, it is preferred that the antenna's directivity pattern exhibit somewhat 'above the horizon' coverage. In particular, the subreflector may be shaped such that the generally hemispherical radiation pattern 80 has a peak gain in a peak gain region 83 that extends from a first prescribed elevation differential that is slightly (e.g., up to +15°) above the horizon to a second prescribed elevation differential that is slightly (e.g., down to −15° below the horizon).

As can be seen from the ray traces 45 in FIG. 4, the feed horn 42 will cause a partial blockage of rays 41 that are reflected downwardly by the shaped subreflector 40 toward the ground. As described earlier, and as will be appreciated from the directivity pattern 80 of FIG. 8, although partial blockage causes a null-type reduction in antenna gain in the nadir direction 85, this gain reduction is acceptable in a UAV application, as it will last for only a very abbreviated interval (fraction of second) when the UAV platform 86 passes directly over the ground station 84 (at which point range-based propagation loss is a minimum). Of particular significance is the fact that the principal theater of deployment of the UAV is over a hostile environment that is geographically remote (e.g., multi tens of miles) from the ground station. At this distance, and low elevation angle, the directivity pattern has substantial gain and no blockage, so that nadir-associated gain reduction is not a practical problem.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed is:

1. A method of providing a communication link between a first site and a second site comprising the steps of:

(a) coupling communication equipment at said first site with a feed element for an antenna structure employed at said first site; and (b) configuring said antenna structure as a ring focus subreflector formed as a shaped ellipsoid that is exclusive of an associated main reflector, said ring focus subreflector being operative to direct RF energy emanating from said feed element in a generally hemispherical radiation pattern that encompasses the horizon and a region along a boresight of said antenna structure that includes said second site.

2. A method according to claim 1, wherein said ring focus subreflector is configured such that said radiation pattern has a peak gain in the vicinity of the horizon.

3. A method according to claim 1, wherein said ring focus subreflector is configured such that said radiation pattern has a peak gain within a prescribed elevation range above and below the horizon.

4. A method according to claim 1, wherein said radiation pattern has a reduced gain in the nadir direction.

5. A method according to claim 1, wherein said first site comprises an unmanned aerial vehicle.

6. A method according to claim 1, wherein said first site comprises an aerial communications platform and said second site comprises a ground station, and wherein step (a) comprises coupling communication equipment of said aerial communications platform with said feed element for said ring focus antenna structure that is carried by said aerial communications platform, and step (b) comprises arranging said ring focus subref lector to direct said RF energy emanating from said feed element in a generally hemispherical radiation pattern that encompasses the horizon and a terrestrial region beneath said aerial communications platform that includes said ground station.

7. A method of providing a communication link between a first communications location and a second communications location comprising the steps of:

(a) coupling communication equipment of said first communications location with a feed element for an antenna structure; and (b) providing said antenna structure as a shaped ellipsoid subreflector of a ring focus antenna that is rotationally symmetric about an axis of said feed element, and is configured to direct RF energy emanating from said feed element in a generally hemispherical radiation pattern that exhibits a maximum gain over a peak gain region extending from a first prescribed elevation differential slightly above the horizon to a second prescribed elevation differential slightly below the horizon, and encompassing said second communications location.

8. A method according to claim 7, wherein said first location corresponds to an aerial communications platform and said second location corresponds to a ground station.

9. A method according to claim 7, wherein said radiation pattern has a reduced gain in the nadir direction.

10. An antenna of the type employed for air-to-ground link hemispherical communication coverage comprising an ellipsoid shaped ring focus type subreflector, that is rotationally symmetric about a boresight axis of a feed horn to which communication equipment on board an aerial vehicle is coupled, and being exclusive of an associated main reflector that may otherwise intercept rays emanating from said subreflector in a generally hemispherical pattern, said generally hemispherical radiation pattern extending toward the horizon and encompassing a ground station, and wherein said subreflector is shaped such that said hemispherical radiation pattern has a peak gain profile that extends from a first prescribed elevation differential slightly above the horizon to a second prescribed elevation differential slightly below the horizon.

11. An antenna for providing a communication link between a first location and a second location remote with respect to said first location, said antenna comprising an RF energy feed element to which communication equipment of said first communications location is coupled, and a shaped ring focus subreflector that is rotationally symmetric about an axis of said feed element, and shaped as a non-regular conical surface of revolution, and being configured to project RF energy directed thereon from said feed element in a generally hemispherical radiation pattern, exclusive of a main reflector, said generally hemispherical radiation pattern exhibiting peak gain toward the horizon and encompassing said second communications location.

12. An antenna according to claim 11, wherein said first location corresponds to an aerial communications platform and said second location corresponds to a ground station.

13. An antenna according to claim 11, wherein said generally hemispherical radiation pattern exhibits peak gain in a peak gain region that extends from a first prescribed elevation differential slightly above the horizon to a second prescribed elevation differential slightly below the horizon.

14. An antenna according to claim 11, wherein said shaped subreflector comprises a shaped ellipsoid subreflector of a ring focus antenna.

15. An antenna according to claim 11, wherein said radiation pattern has a reduced gain in the nadir direction.

16. An antenna according to claim 11, wherein said feed element is adjacent to a vertex to said ring focus subreflector on a boresight axis of said antenna.

17. An antenna according to claim 11, wherein said feed element has a feed aperture thereof located a distance on the order of two to three wavelengths of the frequency of operation of said antenna from a vertex of said subreflector.

* * * * *